US007207438B2

(12) United States Patent
Lieffring et al.

(10) Patent No.: US 7,207,438 B2
(45) Date of Patent: Apr. 24, 2007

(54) TOOL TRAY ASSEMBLY WITH UNIVERSAL SUPPORT SYSTEM

(76) Inventors: Charles A. Lieffring, Box 309, 200 SE. Grand D.D., Faucett, MO (US) 64448; Francis E. Lieffring, 16684 Hwy. 71, Savannah, MO (US) 64485

( * ) Notice: Subject to any disclaimer, the term of this patent is extended or adjusted under 35 U.S.C. 154(b) by 405 days.

(21) Appl. No.: 10/774,918

(22) Filed: Feb. 6, 2004

(65) Prior Publication Data

US 2004/0159578 A1 Aug. 19, 2004

Related U.S. Application Data

(60) Provisional application No. 60/447,785, filed on Feb. 13, 2003.

(51) Int. Cl.
*B65D 85/28* (2006.01)

(52) U.S. Cl. ..... 206/378; 206/373; 220/23.4; 220/23.83; 108/44; 108/143

(58) Field of Classification Search ..... 206/349, 206/372, 373, 374, 378, 557, 504; 220/23.4, 220/23.83, 629, 630, 636; 248/676, 688, 248/188, 188.1, 188.8; 108/98, 176, 143, 108/149, 157, 158, 157.18, 157.1, 158.12
See application file for complete search history.

(56) References Cited

U.S. PATENT DOCUMENTS 3,048,457 A * 8/1962 Haase ..... 108/44
3,269,555 A 8/1966 Henderson
4,309,009 A * 1/1982 Mitchell ..... 248/149
4,341,304 A 7/1982 Diller
4,524,701 A * 6/1985 Chappell ..... 108/44
5,195,636 A * 3/1993 Wridt ..... 206/378
5,706,991 A 1/1998 Stewart
5,950,972 A * 9/1999 Irish ..... 248/210
6,038,984 A * 3/2000 Freitag ..... 108/44
D424,806 S 5/2000 Dixon, Sr.
6,109,435 A 8/2000 Failor
D481,282 S 10/2003 Kitchen

* cited by examiner

*Primary Examiner*—Mickey Yu
*Assistant Examiner*—Steven Pollicoff
(74) *Attorney, Agent, or Firm*—Jeffrey L. Thompson; Thompson & Thompson, P.A.

(57) ABSTRACT

A tool tray having a universal support system enables the tool tray to be placed on a variety of working surfaces. The tool tray includes a rectangular platform having a flat surface surrounded by a plurality of upstanding walls. The platform is supported by four legs which are attached to the platform and protrude downwardly therefrom. The legs each have a bottom surface for supporting the platform on a horizontal surface, and a tapered inner side surface for engaging opposite sides of a vehicle tire for supporting the platform on the vehicle tire. The legs are slidably adjustable to accommodate different sizes of vehicle tires. Two detachable socket trays and a detachable parts tray are attached to the platform by respective structures that hook over the upper edges of the platform. Handles are formed at respective opposite ends of the platform to facilitate lifting and carrying the tool tray assembly.

17 Claims, 4 Drawing Sheets

TOOL TRAY ASSEMBLY WITH UNIVERSAL SUPPORT SYSTEM

RELATED APPLICATIONS

This application claims priority under 35 U.S.C. 119(e) of the Applicants' Provisional Patent Application No. 60/447,785 filed on Feb. 13, 2003.

BACKGROUND OF THE INVENTION

1. Field of the Invention

The present invention relates generally to trays for holding things and, in particular, to trays for holding tools and the like which can be supported on a variety of surfaces, including vehicle tires, to adapt to different working environments.

2. Description of the Prior Art

Mobile machinery, such as trucks, buses, trailers, farm tractors, automobiles, and so forth, often exhibit mechanical failures that require servicing by mechanics. Such mechanical failures occur at various times and locations. For example, vehicles may suffer a mechanical failure requiring immediate attention along the roadside, or the mechanical failure may be such that the vehicle can be located in a more convenient location, such as a garage, to perform the repairs. The present invention is useful for both on-site repair work and for repair and service work in garage-type environments.

A problem often exists that mechanics have only limited or inconvenient places to keep their tools. Typically tools are kept in large toolboxes and the mechanic will remove from the large toolboxes only those selected tools needed to conduct the repair. As the repairs are made, the selected tools being used by the mechanic are normally placed somewhere on the ground or a shelf near the machinery or placed on the machinery itself. For example, it has become common for truck and semi mechanics to utilize one of the front tires of the truck or semi tractor as a tray of sorts to receive tools, parts, and the like while conducting repairs or servicing the machine. These practices often pose safety hazards because the mechanic or other persons can trip on the tools. The tools may also be damaged or lost because they fall out of position or they are left in machinery that leaves the garage.

Small portable toolboxes, usually with flat bottoms, are sometimes used near the machinery to keep the mechanic's tools better organized. However, placing flat-bottomed toolboxes on bumpers, fenders, tires, or other such rounded parts of the machinery is often difficult and results in the toolbox overturning and spilling the contents.

Several attempts have been made in the prior art to provide improved tool trays that can be positioned on a tire or other rounded parts of the machinery. For example, Diller (U.S. Pat. No. 4,341,304) discloses a tool tray having a base with an open bottom that can be placed on top of a tire. The tool tray of Diller is shaped to accommodate a limited number of different tire sizes, but is limited in size and cannot be reconfigured easily to accommodate different working conditions and environments.

Failor (U.S. Pat. No. 6,109,435) discloses a tool kit for containing repair tools and parts, which is adapted to be supported by the upper portion of a front tire of a truck. The tool kit has a unitary body with several built-in trays, a flat center section, and a pair of handles. The body is shaped to fit snugly over a particular shape and size of tire.

Stewart (U.S. Pat. No. 5,706,991) discloses a portable tool holder with a stabilizing base having a curved shape to provide a support when the holder is placed upon a wheel. Multiple compartments are defined on a top section of the tool holder using partitions and side edges. The dimensions of the base are preselected to fit a particular wheel size.

Dixon, Sr. (U.S. Pat. No. Des. 424,806) discloses an ornamental design for a tire-supported tool tray. Freitag (U.S. Pat. No. 6,038,984) and Kitchen (U.S. Des. 481,282) both disclose tool trays having spring structures for clamping to the top of a vehicle tire. Henderson (U.S. Pat. No. 3,269,555) discloses a tray having a spring gripping structure for securing the tray to a center hump on the floor of a vehicle.

The prior art devices described above fail to provide a tool tray that can be adjusted easily to fit a wide variety of tire shapes and sizes, and that can be reconfigured as desired to accommodate different tool collections, repair jobs, and working environments. Thus, there is a need in the industry for an improved tool tray assembly that overcomes these problems and limitations of the prior art devices.

SUMMARY OF THE INVENTION

An object of the present invention is to provide a simple yet highly functional tray assembly to hold and organize tools and other items in a variety of working environments.

A further object of the present invention is to provide a tool tray assembly having a universal support system that allows the tray to be supported on a flat, horizontal surface, or on a narrow curved surface, such as an automotive tire.

A still further object of the present invention is to provide a tool tray assembly that can be adjusted easily to accommodate different sizes and shapes of tires, and that can be reconfigured easily to hold tools and other items in different arrangements to suit a particular mechanic's preference or working environment.

It is a further object of the present invention to provide a tool tray assembly that is economical to manufacture, efficient and reliable in use, capable of a long operating life, and particularly well suited for use by mechanics that work on large vehicles, such as farm tractors, semi-trucks and other large commercial vehicles.

To accomplish these and other objects, a tool tray assembly having a universal support system is provided by the present invention. The tool tray assembly has a generally rectangular platform having a generally flat surface surrounded by a plurality of upstanding sidewalls. A support system is provided for supporting the platform on a variety of work surfaces. The support system includes first and second pairs of legs that are attached to the platform and protrude downwardly therefrom. Each of the legs have a bottom surface and a tapered inner side surface. The bottom surfaces of the legs are arranged for supporting the platform on a horizontal surface, and the tapered inner side surfaces are arranged for engaging opposite sides of a vehicle tire for supporting the platform on the vehicle tire. The first and second pairs of legs are slidably adjustable such that a spacing between the inner side surfaces of the first pair of legs and a spacing between the inner side surfaces of the second pair of legs can be adjusted to fit different sizes of vehicle tires.

Two detachable socket trays and a detachable parts tray are attached to the platform by respective structures that hook over the upper edges of the platform. These socket trays and parts tray can be removed from the platform and/or rearranged on the platform to accommodate different mechanics and working conditions. Handles are formed at respective opposite ends of the platform to facilitate lifting and carrying the tool tray assembly.

According to a broad aspect of the present invention, a tool tray assembly is provided, comprising a platform for holding things, and a support system for supporting the platform on a variety of work surfaces. The support system comprises a plurality of legs attached to the platform and protruding downwardly therefrom, the legs each having a bottom surface and a tapered inner side surface. The bottom surfaces of the legs are arranged for supporting the platform on a horizontal surface, and the tapered inner side surfaces are arranged for supporting the platform on a vehicle tire.

According to another broad aspect of the present invention, a tool tray assembly is provided, comprising a generally rectangular platform having a generally flat surface surrounded by a plurality of upstanding walls, and a support system for supporting the platform on a variety of work surfaces. The support system comprises first and second pairs of legs attached to the platform and protruding downwardly therefrom, each of the legs having a bottom surface and a tapered inner side surface. The bottom surfaces of the legs are arranged for supporting the platform on a horizontal surface, and the tapered inner side surfaces are arranged for engaging opposite sides of a vehicle tire for supporting the platform on the vehicle tire. The first and second pairs of legs are slidably adjustable relative to each other such that a spacing between the inner side surfaces of the legs can be adjusted to fit different sizes of vehicle tires.

Numerous other objects and advantages of the present invention will be apparent to those skilled in this art from the following description wherein there is shown and described a preferred embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

A tool tray assembly 10 having a universal support system according to the present invention will now be described with reference to FIGS. 1 to 4 of the accompanying drawings.

Figure 1:
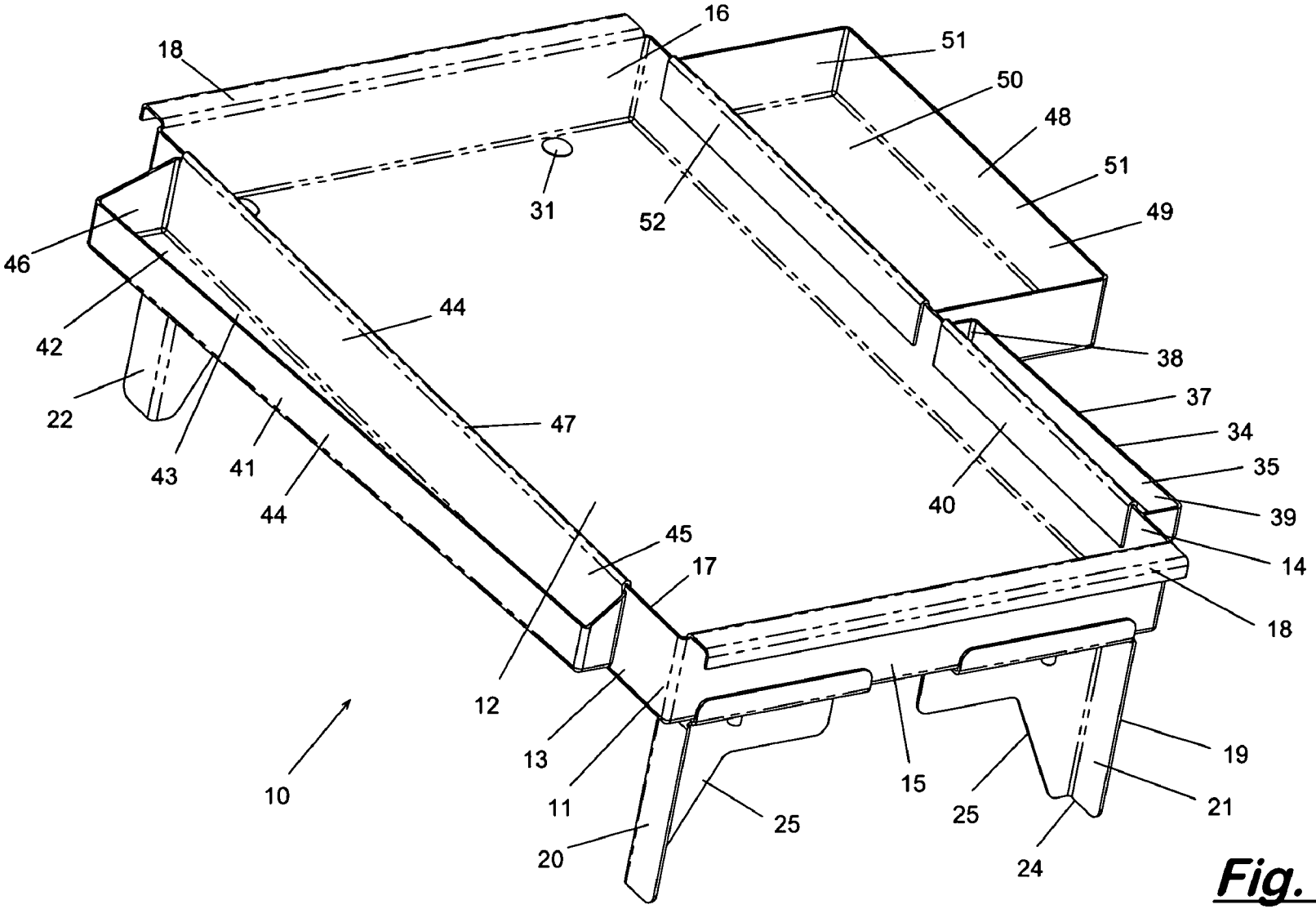
FIG. 1 is a perspective view of a tool tray according to the present invention.
Figure 2:
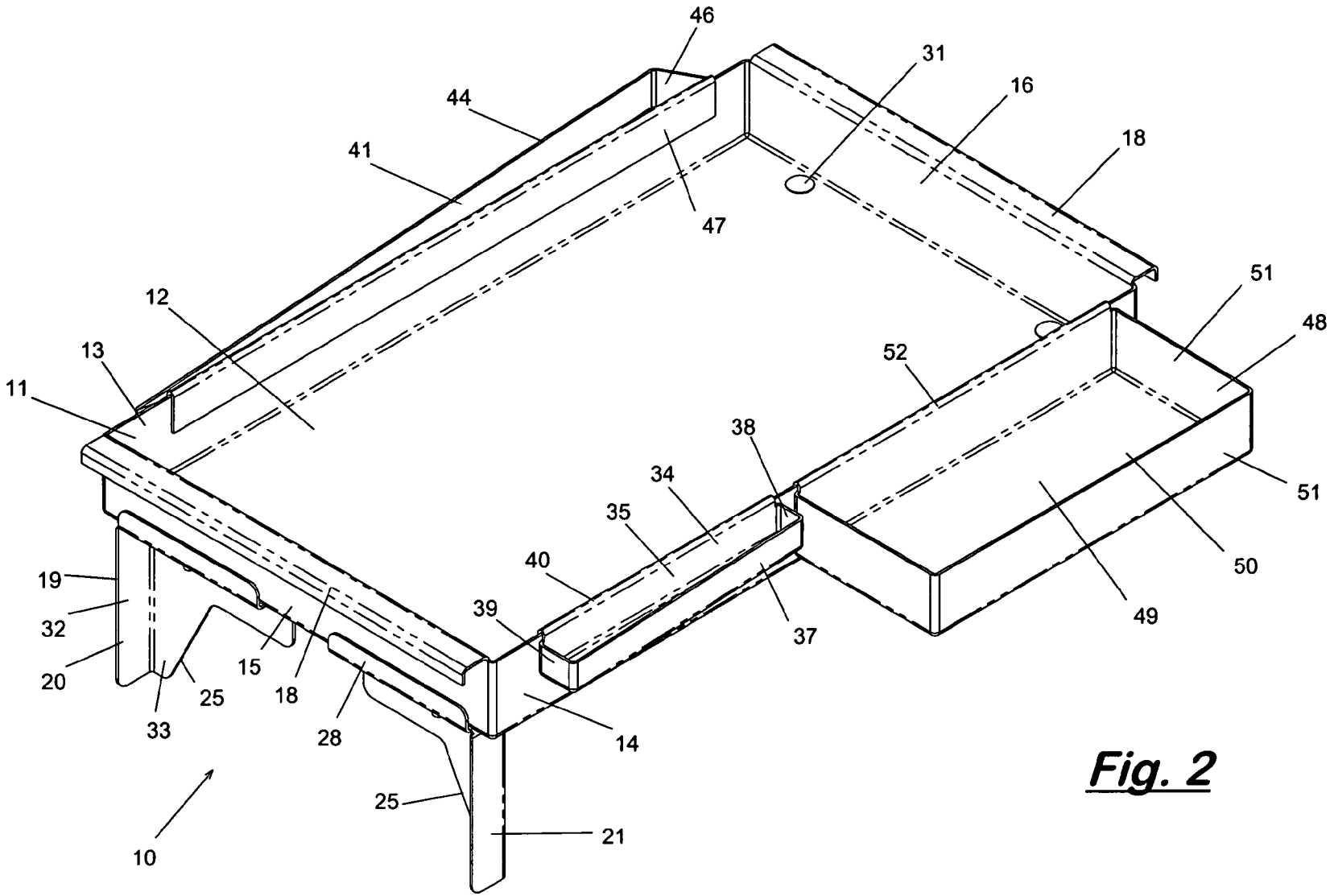
FIG. 2 is a perspective view of the tool tray shown in FIG. 1 as viewed from a different angle.
Figure 3:
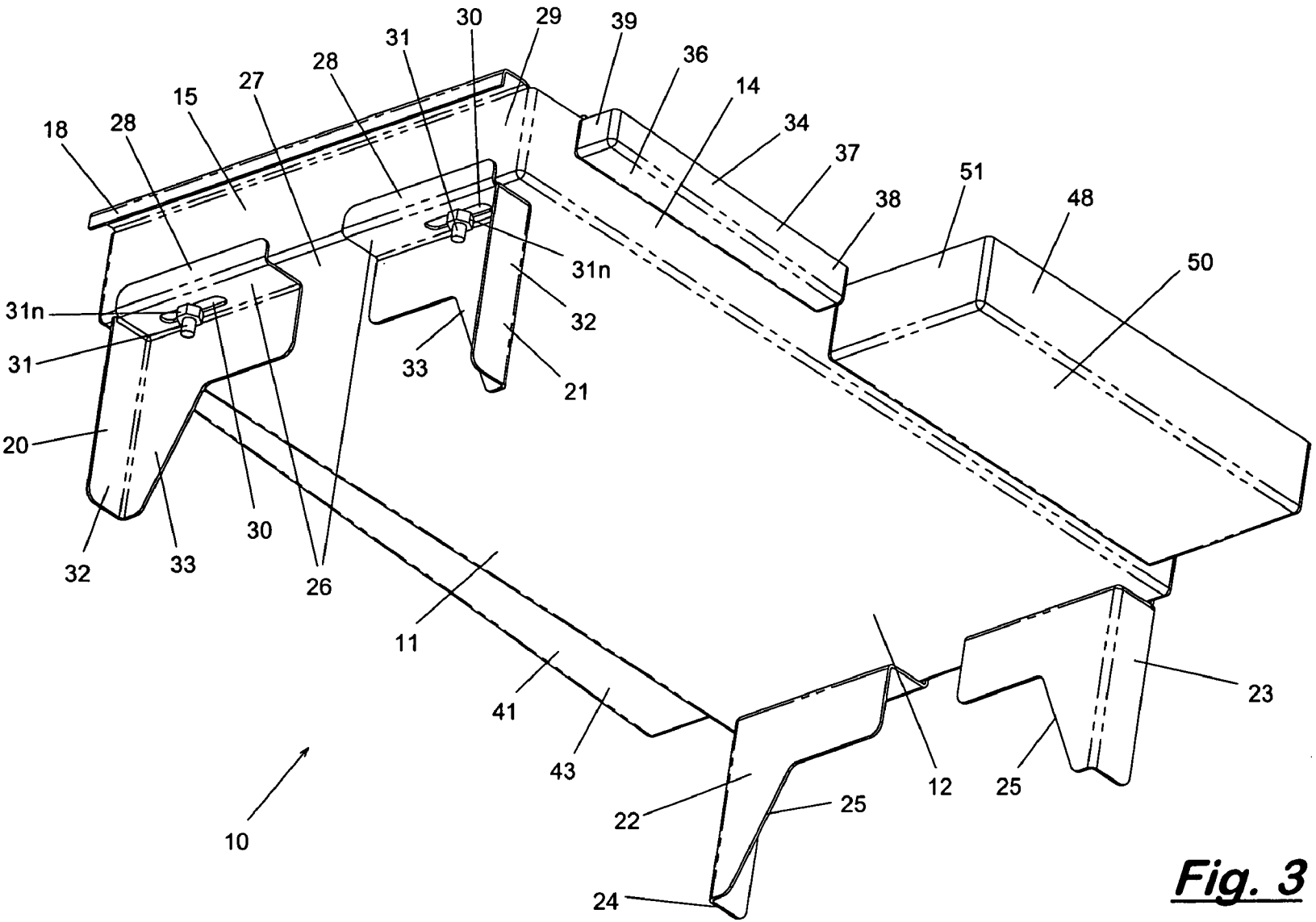
FIG. 3 is a perspective view of the tool tray shown in FIGS. 1 and 2 as viewed from a different angle showing the bottom features of the tool tray.
Figure 4:
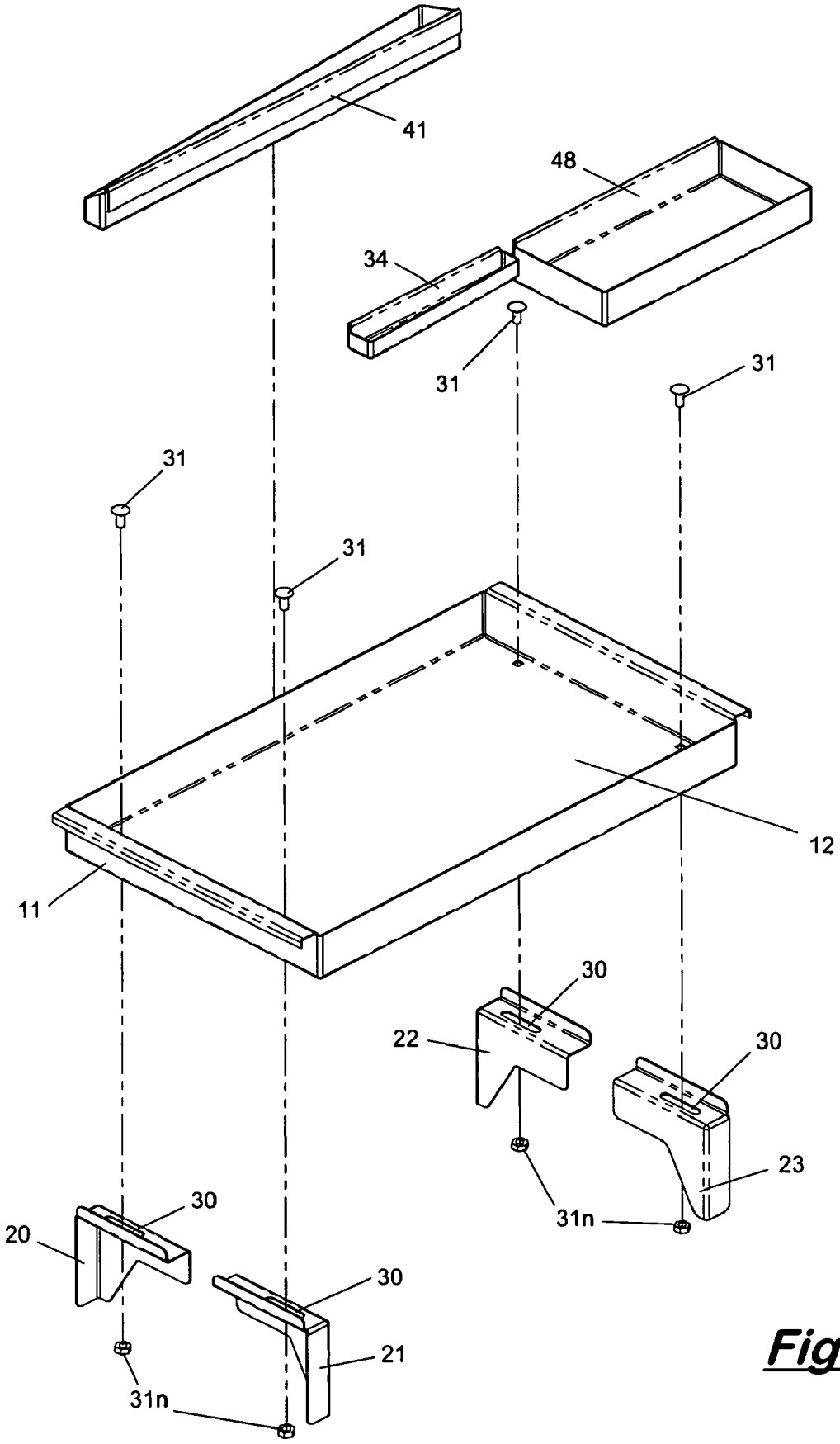
FIG. 4 is an exploded perspective view of the tool tray shown in FIGS. 1 to 3 showing the separate components before they are assembled together.

FIGS. 1 to 3 show perspective views of the tool tray assembly 10 according to the present invention. FIG. 4 also shows a perspective view of the tool tray assembly 10, with the various individual components shown in a disassembled state. The tool tray assembly 10 includes a generally rectangular platform 11 for holding things, such as tools, supplies, and parts. The platform 11 has a generally flat surface 12 surrounded by a plurality of upstanding walls 13–16. The upstanding side walls 13, 14 of the platform 11 have narrow upper edges 17 on which various attachments can be hung, as described below. The upstanding end walls 15, 16 of the platform 11 have upper edges that are folded into an inverted U-shaped configuration to form handles 18 at respective opposite ends of the platform 11 to facilitate lifting and carrying the tool tray assembly 10. The platform 11 is preferably made of sheet metal which is bent into the desired configuration and welded or riveted together to form a rigid structure. Alternatively, the platform 11 can be made of molded plastic material to reduce manufacturing costs.

A support system 19 is provided for supporting the platform 11 on a variety of work surfaces. The support system 19 comprises four legs 20–23 that are attached to the platform 11 near each of the four corners of the platform 11 and protrude downwardly therefrom. Each of the legs 20–23 has a bottom surface 24 and a tapered inner side surface 25. The bottom surfaces 24 of the legs 20–23 are arranged for supporting the platform 11 on a horizontal surface, and the tapered inner side surfaces 25 are arranged for engaging opposite sides of a narrow, curved surface, such as a vehicle tire, for supporting the platform 11 on the vehicle tire. The four legs 20–23 are arranged with a first pair 20, 21 of the legs near one end of the platform 11 and a second pair 22, 23 of the legs near the other end of the platform 11.

Each of the legs 20–23 has a first flat portion 26 for engaging a bottom surface 27 of the platform 11, and a second stabilizing portion 28 extending upwardly from the first flat portion 26 for engaging an end surface 29 of the platform 11. A slotted opening 30 is formed in the first flat portion 26 for slidably receiving a threaded fastener 31, such as a cap screw or carriage bolt, for attaching the leg 20–23 to the platform 11. A threaded nut 31*n* (e.g., a wing nut) is provided to mate with each threaded fastener 31. A third downwardly projecting portion 32 extends downwardly from the first flat portion 26 to the bottom surface 24 of each of the legs 20–23. A fourth inwardly projecting portion 33 extends inwardly from the third downwardly projecting portion 32 to form the tapered inner side surface 25. The tapered inner side surfaces 25 taper downwardly and outwardly from the bottom surface 27 of the platform 11 and are arranged to engage opposite sides of a vehicle tire when the tray assembly 10 is placed on the tire. The legs 20–23 are preferably made of sheet metal, which is bent and welded to form a rigid structure. Alternatively, the legs 20–23 can be made of molded plastic material to reduce manufacturing costs.

The legs 20, 21 of the first pair of legs are slidably adjustable relative to each other by loosening the corresponding threaded fasteners 31, sliding the legs 20, 21 relative to the platform 11, and then retightening the threaded fasteners 31. The slotted openings 30 in the legs 20, 21 allow the legs to slide relative to the threaded fasteners 31. The stabilizing portions 28 of the legs 20, 21 keep the legs properly oriented relative to the platform 11 while allowing sliding movement in directions parallel to the slotted openings 30. Similarly, the legs 22, 23 of the second pair of legs are slidably adjustable relative to each other by loosening the corresponding threaded fasteners 31, sliding the legs 22, 23 relative to the platform 11, and then retightening the threaded fasteners 31. With this arrangement, the spacing between the inner side surfaces 25 of the first and second pairs of legs 20–21 and 22–23, respectively, can be adjusted to fit different sizes of vehicle tires (e.g., semi-truck tires, farm tractor tires, school bus tires, etc.).

A first detachable socket tray 34 is provided for holding a first socket set (e.g., a ⅜ inch drive set). The first detachable socket tray 34 has a space 35 for holding sockets defined by a generally flat bottom surface 36 surrounded by a plurality of upstanding sides 37. The space 35 has a width that gradually increases from a narrow end 38 to a wide end 39, with the narrow end 38 corresponding in size to a smallest socket of the first socket set, and the wide end 39 corresponding in size to a largest socket of the first socket set. The first detachable socket tray 34 is attached to the platform 11 by an inverted J-shaped structure 40 that extends along the length of the tray 34 and hooks over an upper edge 17 of one of the upstanding side walls 13, 14 of the platform 11 and hangs therefrom.

A second detachable socket tray 41 is provided for holding a second socket set (e.g., a ½ inch drive set). The second detachable socket tray 41 has generally the same structure as the first detachable socket tray 34, except that a space 42 for holding sockets defined by the second socket tray 41 is larger than the space 35 for holding sockets defined by the first socket tray 34. The space 42 for holding sockets in the second socket tray 41 is defined by a generally flat bottom surface 43 surrounded by a plurality of upstanding sides 44. The space 42 has a width that gradually increases from a narrow end 45 to a wide end 46, with the narrow end 45 corresponding in size to a smallest socket of the second socket set, and the wide end 46 corresponding in size to a largest socket of the second socket set. The second detachable socket tray 41 is attached to the platform 11 by an inverted J-shaped structure 47 that extends along the length of the tray 41 and hooks over an upper edge 17 of one of the upstanding side walls 13, 14 of the platform 11 and hangs therefrom.

A detachable parts tray 48 is attached to the platform 11 for holding bolts and/or other parts of a machine being worked on. The detachable parts tray 48 has a rectangular compartment or space 49 for holding bolts and other parts defined by a generally flat bottom surface 50 surrounded by a plurality of upstanding sides 51. The detachable parts tray 48 is attached to the platform 11 by an inverted J-shaped structure 52 that extends along a length of one side of the tray 48 and hooks over an upper edge 17 of a sidewall 13, 14 of the platform 11 and hangs therefrom. The parts tray 48 is particularly useful for keeping bolts and other small parts of a machine being worked on in an organized and easily accessible location.

The detachable parts tray 48 and the first and second detachable socket trays 34, 41 are easily removable and interchangeable to different locations on the platform 11 by merely lifting them out of engagement with the upstanding sidewalls 13, 14 and moving them to a desired location. Moreover, the tool tray assembly 10 can be disassembled easily and placed into a compact arrangement for transport and/or storage by detaching the four legs 20–23, the socket trays 34, 41, and the parts tray 48 from the platform 11 and placing all of the detached components within the compartment defined by the flat surface 12 and upstanding walls 13–16 of the platform 11.

While the invention has been specifically described in connection with specific embodiments thereof, it is to be understood that this is by way of illustration and not of limitation, and the scope of the appended claims should be construed as broadly as the prior art will permit.

What is claimed is:

1. A tool tray assembly comprising:

a platform for holding things; and a support system for supporting the platform on a variety of work surfaces, the support system comprising a plurality of legs attached to the platform and protruding downwardly therefrom, said legs each having a bottom surface and a tapered inner side surface, said bottom surfaces of the legs being arranged for supporting the platform on a horizontal surface and said tapered inner side surfaces being arranged for supporting the platform on a vehicle tire, wherein said platform has a configuration with a bottom surface and at least one end surface, and said plurality of legs comprises a first pair of legs protruding downwardly from the platform, each of said first pair of legs having a first flat portion for engaging the bottom surface of the platform, a second stabilizing portion extending upwardly from said first flat portion for engaging the end surface of the platform, a slotted opening formed in said first flat portion for slidably receiving a fastener for attaching the leg to the platform, and a portion extending downwardly from the flat portion to form the bottom surface and the tapered inner side surface, wherein the tapered inner side surfaces are arranged to engage opposite sides of a vehicle tire when the tray assembly is placed on the tire.

2. The tool tray assembly according to claim 1, wherein said platform comprises a generally flat surface surrounded by a plurality of upstanding walls.

3. The tool tray assembly according to claim 1, wherein said first pair of legs which are adjustably mounted to the platform, and said first pair of legs slidably adjustable relative to each other such that a spacing between the inner side surfaces of said first pair of legs can be adjusted to fit different sizes of vehicle tires.

4. The tool tray assembly according to claim 3, wherein said plurality of legs further comprises a second pair of legs which are adjustably mounted to the platform at a location spaced from said first pair of legs, said second pair of legs being slidably adjustable relative to each other such that a spacing between the inner side surfaces of said second pair of legs can be adjusted to fit different sizes of vehicle tires.

5. The tool tray assembly according to claim 1, further comprising a first detachable socket tray attached to the platform for holding a first socket set.

6. The tool tray assembly according to claim 5, wherein said platform comprises a generally flat surface surrounded by a plurality of upstanding walls, and wherein said first detachable socket tray is attached to one of the upstanding walls by a structure that hooks over an upper edge of the wall and hangs therefrom.

7. The tool tray assembly according to claim 5, wherein said first detachable socket tray has a space for holding sockets defined by a generally flat bottom surface surrounded by a plurality of upstanding sides, said space having a width that gradually increases from a narrow end to a wide end, whereby the narrow end corresponds in size to a smallest socket of the first socket set and the wide end corresponds in size to a largest socket of the first socket set.

8. The tool tray assembly according to claim 5, further comprising a second detachable socket tray attached to the platform for holding a second socket set.

9. The tool tray assembly according to claim 8, wherein said second detachable socket tray has generally the same structure as said first detachable socket tray except that a space for holding sockets defined by said second socket tray is larger than a space for holding sockets defined by said first socket tray, whereby said second socket tray can be used to hold a second socket set which is larger than said first socket set.

10. The tool tray assembly according to claim 9, further comprising a detachable parts tray attached to the platform for holding bolts and/or other parts of a machine being worked on.

11. The tool tray assembly according to claim 10, wherein said platform comprises a generally flat surface surrounded by a plurality of upstanding walls, and wherein said first and second detachable socket trays and said detachable parts tray are attached to the platform by respective structures that hook over respective upper edges of the upstanding walls of the platform and hang therefrom.

12. The tool tray assembly according to claim 1, further comprising handles formed at respective opposite ends of the platform to facilitate lifting and carrying the tool tray assembly.

13. A tool tray assembly comprising:

a platform for holding things; and a support system for supporting the platform on a variety of work surfaces, the support system comprising a plurality of legs attached to the platform and protruding downwardly therefrom, said legs each having a bottom surface and a tapered inner side surface, said bottom surfaces of the legs being arranged for supporting the platform on a horizontal surface and said tapered inner side surfaces being arranged for supporting the platform on a vehicle tire;

wherein said platform has a generally rectangular configuration and said plurality of legs comprises four legs protruding downwardly from the platform near the four corners of the rectangular configuration, each of said legs having a first flat portion for engaging a bottom surface of the platform, a second stabilizing portion extending upwardly from said first flat portion for engaging an end surface of the platform, a slotted opening formed in said first flat portion for slidably receiving a threaded fastener for attaching the leg to the platform, a third downwardly projecting portion extending downwardly from said first flat portion to the bottom surface of the leg, and a fourth inwardly projecting portion extending inwardly from the third downwardly projecting portion to form the tapered inner side surface, wherein the tapered inner side surfaces are arranged to engage opposite sides of a vehicle tire when the tray assembly is placed on the tire.

14. The tool tray assembly according to claim 1, wherein the platform and the plurality of legs are formed of sheet metal.

15. A tool tray assembly comprising: p1 a generally rectangular platform having a generally flat surface surrounded by plurality of upstanding walls; and a support system for supporting the platform on a variety of work surfaces, the support system comprising first and second pairs of legs attached to the platform and protruding downwardly therefrom, each of said legs having a bottom surface and a tapered inner side surface, said bottom surfaces of the legs being arranged for supporting the platform on a horizontal surface and said tapered inner side surfaces being arranged for engaging opposite sides of a vehicle tire for supporting the platform on the vehicle tire;

said first pair of legs being slidably adjustable relative to each other such that a spacing between the inner side surfaces of said first pair of legs can be adjusted to fit different sizes of vehicle tires; and said second pair of legs being slidably adjustable relative to each other such that a spacing between the inner side surfaces of said second pair of legs can be adjusted to fit different sizes of vehicle tires;

further comprising a first detachable socket tray for holding a first socket set, said first detachable socket tray having a space for holding sockets defined by a generally flat bottom surface surrounded by a plurality of upstanding sides, said space having a width that gradually increases from a narrow end to a wide end, whereby the narrow end corresponds in size to a smallest socket of the first socket set and the wide end corresponds in size to a largest socket of the first socket set, said first detachable socket tray being attached to the platform by a structure that hooks over an upper edge of one of the upstanding walls of the platform and hangs therefrom;

further comprising a second detachable socket tray attached to the platform for holding a second socket set, wherein said second detachable socket tray has generally the same structure as said first detachable socket tray except that a space for holding sockets defined by said second socket tray is larger than a space for holding sockets defined by said first socket tray, whereby said second socket tray can be used to hold a second socket set which is larger than said first socket set;

further comprising a detachable parts tray attached to the platform for holding bolts and/or other parts of a machine being worked on, said detachable parts tray having a space for holding bolts and other parts defined by a generally flat bottom surface surrounded by a plurality of upstanding sides, said detachable parts tray being attached to the platform by a structure that hooks over an upper edge of one of the upstanding walls of the platform and hangs therefrom.

16. The tool tray assembly according to claim 15, further comprising handles formed at respective opposite ends of the platform to facilitate lifting and carrying the tool tray assembly.

17. The tool tray assembly according to claim 16, wherein the platform and the plurality of legs are formed of sheet metal.

* * * * *